US008405593B2

(12) United States Patent
Liu et al.

(10) Patent No.: US 8,405,593 B2
(45) Date of Patent: Mar. 26, 2013

(54) LIQUID CRYSTAL DEVICE WITH MULTI-DOT INVERSION

(75) Inventors: Sheng-Chao Liu, Hsin-Chu (TW); Tsang-Hong Wang, Hsin-Chu (TW); Chi-Mao Hung, Hsin-Chu (TW); Chung-Lung Li, Hsin-Chu (TW); Shih-Hsiang Chou, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 810 days.

(21) Appl. No.: 12/550,414

(22) Filed: Aug. 31, 2009

(65) Prior Publication Data

US 2010/0225570 A1 Sep. 9, 2010

(30) Foreign Application Priority Data

Mar. 6, 2009 (TW) ..... 98107388 A

(51) Int. Cl.
*G09G 3/36* (2006.01)

(52) U.S. Cl. ..... 345/92; 345/87

(58) Field of Classification Search ..... None
See application file for complete search history.

(56) References Cited

U.S. PATENT DOCUMENTS 6,980,186 B2 12/2005 Nakano et al.
2004/0189575 A1 * 9/2004 Choi et al. ..... 345/96
2008/0001889 A1 1/2008 Chun et al.
2008/0129904 A1 * 6/2008 Kang et al. ..... 349/37
2008/0158131 A1 * 7/2008 Park et al. ..... 345/98
2010/0164925 A1 * 7/2010 Weng ..... 345/211

FOREIGN PATENT DOCUMENTS

CN 101251697 A 8/2008
CN 101387804 A 3/2009
JP 2003177375 6/2003

* cited by examiner

*Primary Examiner* — Joseph Haley
*Assistant Examiner* — Emily Frank
(74) *Attorney, Agent, or Firm* — Winston Hsu; Scott Margo

(57) ABSTRACT

An LCD device includes a plurality of data lines, a plurality gate lines, a pixel matrix, and a source driver. The pixel matrix includes an mth pixel column and an (m+1)th pixel column. The odd-numbered pixels of the mth pixel column are coupled to an mth data line and corresponding odd-numbered gate lines. The even-numbered pixels of the mth pixel column is coupled to an (m+1)th data line and corresponding even-numbered gate lines. The odd-numbered pixels of the (m+1) th pixel column is coupled to the (m+1)th data line and corresponding odd-numbered gate lines. The even-numbered pixels of the (m+1)th pixel column is coupled to an (m+2)th data line and corresponding even-numbered gate lines. The gate driver outputs the data driving signals having a first polarity to the odd-numbered data lines, and outputs the data driving signals having a second polarity to the even-numbered data lines.

17 Claims, 9 Drawing Sheets

Frame X

| | | | | | |
|---|---|---|---|---|---|
| $P_{11}(+)$ | $P_{21}(-)$ | $P_{31}(+)$ | $P_{41}(-)$ | ····· | $P_{M1}(+)$ |
| $P_{12}(-)$ | $P_{22}(+)$ | $P_{32}(-)$ | $P_{42}(+)$ | ····· | $P_{M2}(-)$ |
| $P_{13}(+)$ | $P_{23}(-)$ | $P_{33}(+)$ | $P_{43}(-)$ | ····· | $P_{M3}(+)$ |
| $P_{14}(-)$ | $P_{24}(+)$ | $P_{34}(-)$ | $P_{44}(+)$ | ····· | $P_{M4}(-)$ |
| ⋮ | ⋮ | ⋮ | ⋮ | ⋱ | ⋮ |
| $P_{1N}(+)$ | $P_{2N}(-)$ | $P_{3N}(+)$ | $P_{4N}(-)$ | ····· | $P_{MN}(+)$ |

FIG. 2a PRIOR ART

Frame (X+1)

| | | | | | |
|---|---|---|---|---|---|
| $P_{11}(-)$ | $P_{21}(+)$ | $P_{31}(-)$ | $P_{41}(+)$ | ····· | $P_{M1}(-)$ |
| $P_{12}(+)$ | $P_{22}(-)$ | $P_{32}(+)$ | $P_{42}(-)$ | ····· | $P_{M2}(+)$ |
| $P_{13}(-)$ | $P_{23}(+)$ | $P_{33}(-)$ | $P_{43}(+)$ | ····· | $P_{M3}(-)$ |
| $P_{14}(+)$ | $P_{24}(-)$ | $P_{34}(+)$ | $P_{44}(-)$ | ····· | $P_{M4}(+)$ |
| ⋮ | ⋮ | ⋮ | ⋮ | ⋱ | ⋮ |
| $P_{1N}(-)$ | $P_{2N}(+)$ | $P_{3N}(-)$ | $P_{4N}(+)$ | ····· | $P_{MN}(-)$ |

FIG. 2b PRIOR ART

| Black | White | Black | White | | White |
|---|---|---|---|---|---|
| $P_{11}(+)$ H | $P_{21}(+)$ L | $P_{31}(-)$ L | $P_{41}(-)$ H | ..... | $P_{M1}(-)$ H |
| $P_{12}(+)$ H | $P_{22}(-)$ H | $P_{32}(-)$ L | $P_{42}(+)$ L | ..... | $P_{M2}(+)$ L |
| $P_{13}(+)$ H | $P_{23}(+)$ L | $P_{33}(-)$ L | $P_{43}(-)$ H | ..... | $P_{M3}(-)$ H |
| $P_{14}(+)$ H | $P_{24}(-)$ H | $P_{34}(-)$ L | $P_{44}(+)$ L | ..... | $P_{M4}(+)$ L |
| ⋮ | ⋮ | ⋮ | ⋮ | ⋱ | ⋮ |
| $P_{1N}(+)$ L | $P_{2N}(-)$ L | $P_{3N}(-)$ L | $P_{4N}(+)$ L | ..... | $P_{MN}(+)$ L |

| Black | Black | White | White | | White |
|---|---|---|---|---|---|
| $P_{11}(+)$ H | $P_{21}(+)$ H | $P_{31}(-)$ H | $P_{41}(-)$ H | ..... | $P_{M1}(-)$ H |
| $P_{12}(+)$ H | $P_{22}(-)$ L | $P_{32}(-)$ H | $P_{42}(+)$ L | ..... | $P_{M2}(+)$ L |
| $P_{13}(+)$ H | $P_{23}(+)$ H | $P_{33}(-)$ H | $P_{43}(-)$ H | ..... | $P_{M3}(-)$ H |
| $P_{14}(+)$ H | $P_{24}(-)$ L | $P_{34}(-)$ H | $P_{44}(+)$ L | ..... | $P_{M4}(+)$ L |
| ⋮ | ⋮ | ⋮ | ⋮ | ⋱ | ⋮ |
| $P_{1N}(+)$ H | $P_{2N}(-)$ L | $P_{3N}(-)$ H | $P_{4N}(+)$ L | ..... | $P_{MN}(+)$ L |

Frame X

| | | | | | |
|---|---|---|---|---|---|
| $P_{11}(+)$ | $P_{21}(+)$ | $P_{31}(-)$ | $P_{41}(-)$ | ····· | $P_{M1}(-)$ |
| $P_{12}(+)$ | $P_{22}(+)$ | $P_{32}(-)$ | $P_{42}(-)$ | ····· | $P_{M2}(-)$ |
| $P_{13}(+)$ | $P_{23}(-)$ | $P_{33}(-)$ | $P_{43}(+)$ | ····· | $P_{M3}(+)$ |
| $P_{14}(+)$ | $P_{24}(-)$ | $P_{34}(-)$ | $P_{44}(+)$ | ····· | $P_{M4}(+)$ |
| ⋮ | ⋮ | ⋮ | ⋮ | ⋱ | ⋮ |
| $P_{1N}(+)$ | $P_{2N}(-)$ | $P_{3N}(-)$ | $P_{4N}(+)$ | ····· | $P_{MN}(+)$ |

FIG. 6a

Frame (X+1)

| | | | | | |
|---|---|---|---|---|---|
| $P_{11}(-)$ | $P_{21}(-)$ | $P_{31}(+)$ | $P_{41}(+)$ | ····· | $P_{M1}(+)$ |
| $P_{12}(-)$ | $P_{22}(-)$ | $P_{32}(+)$ | $P_{42}(+)$ | ····· | $P_{M2}(+)$ |
| $P_{13}(-)$ | $P_{23}(+)$ | $P_{33}(+)$ | $P_{43}(-)$ | ····· | $P_{M3}(-)$ |
| $P_{14}(-)$ | $P_{24}(+)$ | $P_{34}(+)$ | $P_{44}(-)$ | ····· | $P_{M4}(-)$ |
| ⋮ | ⋮ | ⋮ | ⋮ | ⋱ | ⋮ |
| $P_{1N}(-)$ | $P_{2N}(+)$ | $P_{3N}(+)$ | $P_{4N}(-)$ | ····· | $P_{MN}(-)$ |

FIG. 6b

LIQUID CRYSTAL DEVICE WITH MULTI-DOT INVERSION

BACKGROUND OF THE INVENTION

1. Field of the Invention

The present invention relates to an LCD device, and more particularly, to an LCD device with multi-dot inversion.

2. Description of the Prior Art

Liquid crystal display (LCD) devices, characterized in low radiation, thin appearance and low power consumption, have gradually replaced traditional cathode ray tube (CRT) displays and been widely used in electronic devices such as notebook computers, personal digital assistants (PDAs), flat panel TVs or mobile phones.

Reference is made to FIG. 1 for a diagram of a prior art LCD device 100. The LCD device 100 includes a gate driver 110, a source driver 120, and an LCD panel 130. A plurality of parallel data lines $DL_1$-$DL_M$, a plurality of parallel gate lines $GL_1$-$GL_N$ and a pixel matrix having M columns and N rows are disposed on the LCD panel 130. The pixel matrix includes M×N pixels $P_{11}$-$P_{MN}$ respectively disposed at the intersections of corresponding data lines and gate lines. Each pixel includes a thin film transistor (TFT) switch, a liquid crystal capacitor $C_{LC}$ and a storage capacitor $C_{ST}$. The gate driver 110 is coupled to the gate lines $GL_1$-$GL_N$ for sequentially generating the gate driving signals $S_{G1}$-$S_{GN}$, thereby turning on the TFT switches in corresponding pixels. The source driver 120 is coupled to the data lines $DL_1$-$DL_M$ for generating the data driving signals $S_{D1}$-$S_{DN}$ so that the pixels $P_{11}$-$P_{MN}$ can display corresponding images. For example, the pixel $P_{11}$ displays images based on the data driving signal $S_{D1}$ upon receiving the gate driving signal $S_{G1}$, the pixel $P_{12}$ displays images based on the data driving signal $S_{D1}$ upon receiving the gate driving signal $S_{G2}$, the pixel $P_{21}$ displays images based on the data driving signal $S_{D2}$ upon receiving the gate driving signal $S_{G1}$, the pixel $P_{22}$ displays images based on the data driving signal $S_{D2}$ upon receiving the gate driving signal $S_{G2}$, . . . , etc.

Generally, the polarity of the voltage applied across the liquid crystal capacitor $C_{LC}$ and the storage capacitor $C_{ST}$ needs to be switched alternatively with a predetermined interval in order to prevent permanent damage of liquid crystal material due to polarization. For instance, with line inversion, the pixels of two adjacent data/gate lines have opposite polarities; with dot inversion, the polarity of a pixel is opposite to that of its adjacent pixels.

References are made to FIGS. 2*a* and 2*b* for diagrams illustrating the operation of the prior art LCD device 100 when displaying images with dot-inversion. Frame X in FIG. 2*a* and frame (X+1) in FIG. 2*b* represent two continuous frames. In other words, the LCD device 100 immediately displays frame (X+1) after having displayed frame X. As shown in FIGS. 2*a* and 2*b*, to display frame X and frame (X+1) with dot-inversion, the polarities of the data driving signals applied to the data lines need to be inverted after each period of the gate driving signals. Since the common voltage driver and the source driver face maximum loading when performing polarity inversion, the prior art LCD device 100 consumes large power when displaying images with dot-inversion.

SUMMARY OF THE INVENTION

The present invention provides an LCD device with multi-dot inversion comprising a plurality of data lines each for transmitting data driving signals, a plurality of gate lines for transmitting gate driving signals, a pixel matrix, and a source driver. The pixel matrix comprises an mth pixel column including a plurality of pixels and disposed between two adjacent mth and (m+1)th data lines among the plurality of data lines, wherein odd-numbered pixels of the mth pixel column are coupled to the mth data line, and respectively coupled to corresponding odd-numbered gate lines; and even-numbered pixels of the mth pixel column are coupled to the (m+1)th data line, and respectively coupled to corresponding even-numbered gate lines; an (m+1)th pixel column including a plurality of pixels and disposed between two adjacent (m+1)th and (m+2)th data lines among the plurality of data lines, wherein odd-numbered pixels of the (m+1)th pixel column are coupled to the (m+1)th data line and respectively coupled to corresponding odd-numbered gate lines; and even-numbered pixels of the (m+1)th pixel column are coupled to the (m+2)th data line and respectively coupled to corresponding even-numbered gate lines. The source driver outputs data driving signals having a first polarity to odd-numbered data lines and outputs data driving signals having a second polarity to even-numbered data lines when displaying a first frame.

The present invention further provides an LCD device with two-dot inversion comprising first through fifth data lines for transmitting data driving signals, a first gate line and a second gate line for transmitting gate driving signals, a pixel matrix, and a source driver. The pixel matrix comprises a first pixel disposed at a first row and a first column of the pixel matrix and coupled to the first data line and the first gate line for displaying images according to the received gate driving signal and data driving signal; a second pixel disposed at the first row and a second column of the pixel matrix and coupled to the second data line and the first gate line for displaying images according to the received gate driving signal and data driving signal; a third pixel disposed at the first row and a third column of the pixel matrix and coupled to the third data line and the first gate line for displaying images according to the received gate driving signal and data driving signal; a fourth pixel disposed at the first row and a fourth column of the pixel matrix and coupled to the fourth data line and the first gate line for displaying images according to the received gate driving signal and data driving signal; a fifth pixel disposed at a second row and the first column of the pixel matrix and coupled to the second data line and the second gate line for displaying images according to the received gate driving signal and data driving signal; a sixth pixel disposed at the second row and the second column of the pixel matrix and coupled to the third data line and the second gate line for displaying images according to the received gate driving signal and data driving signal; a seventh pixel disposed at the second row and the third column of the pixel matrix and coupled to the fourth data line and the second gate line for displaying images according to the received gate driving signal and data driving signal; and an eighth pixel disposed at the second row and the fourth column of the pixel matrix and coupled to the fifth data line and the second gate line for displaying images according to the received gate driving signal and data driving signal. The source driver outputs data driving signals having a first polarity to the first, the second and the fifth data lines and outputs data driving signals having a second polarity to the third and the fourth data lines when displaying a first frame.

The present invention further provides a method for driving an LCD device with multi-dot inversion comprising providing a plurality of data lines; providing a plurality of gate lines; providing a pixel matrix comprising a plurality of pixel columns having a zigzag layout, wherein an mth pixel column including a plurality of pixels are disposed between two adjacent mth and (m+1) th data lines among the plurality of data lines, odd-numbered pixels of the mth pixel column are coupled to the mth data line, and even-numbered pixels of the mth pixel column are coupled to the (m+1) th data line; outputting data driving signals having a first polarity to odd-numbered data lines and outputting data driving signals having a second polarity to even-numbered lines when displaying a first frame.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIGS. 2*a* and 2*b* are diagrams illustrating the operation of the prior art LCD device when displaying images with dot-inversion.

FIGS. 6*a* and 6*b* are diagrams illustrating the operations of the LCD device in FIG. 3 according to a third embodiment of the present invention.

DETAILED DESCRIPTION

Figure 1:
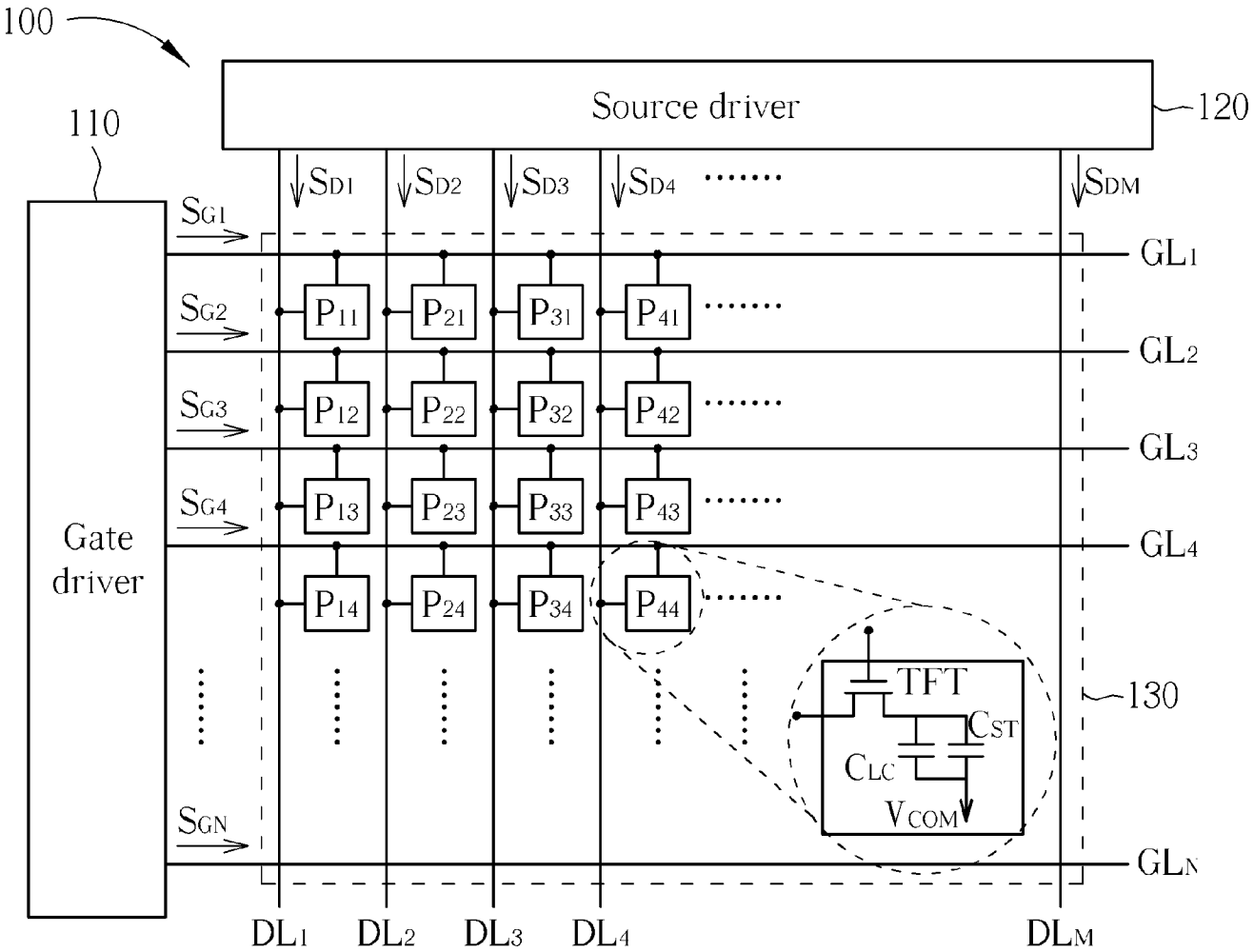
FIG. 1 PRIOR ART
FIG. 1 is a diagram of a prior art LCD device.
Figure 3:
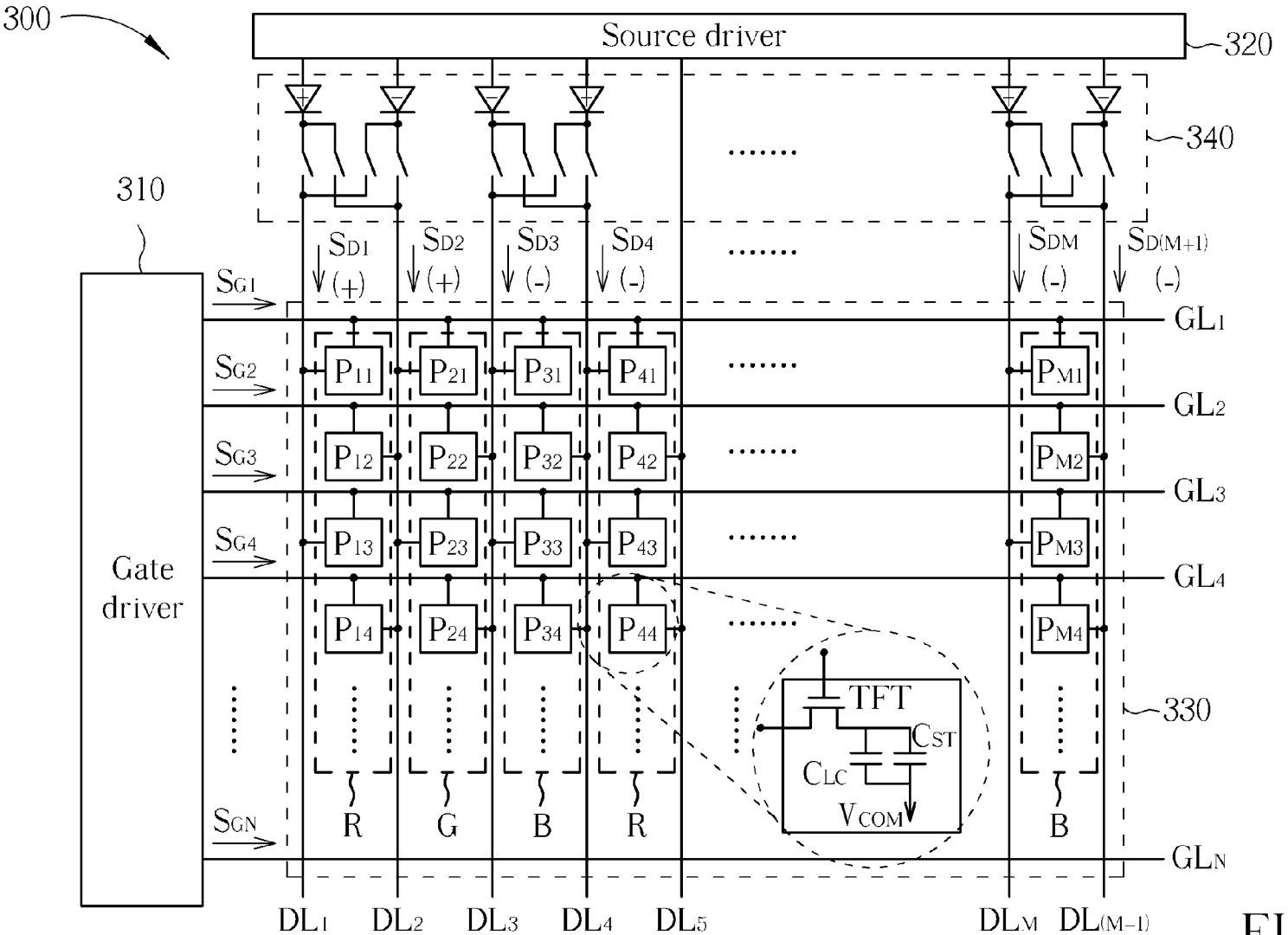
FIG. 3 is a diagram of an LCD device with zigzag pixel arrangement and single-gate structure according to the present invention.

Reference is made to FIG. 3 for a diagram of an LCD device 300 with zigzag pixel arrangement and single-gate structure according to the present invention. The LCD device 300 includes a gate driver 310, a source driver 320, a switch control circuit 340 and an LCD panel 330. A plurality of parallel data lines $DL_1$-$DL_{M+1}$, a plurality of parallel gate lines $GL_1$-$GL_N$ and a pixel matrix having M columns and N rows are disposed on the LCD panel 330. The pixel matrix includes M×N pixels $P_{11}$-$P_{MN}$ respectively disposed at the intersections of corresponding data lines and gate lines. For example, the mth column of pixels $P_{m1}$-$P_{mN}$ (m is a positive integer smaller than M) are disposed between two adjacent date lines $DL_m$ and $DL_{(m+1)}$, wherein the odd-numbered pixels $P_{m1}$, $P_{m3}$, . . . , $P_{m(N-1)}$ are coupled to date line $DL_m$ and respectively coupled to corresponding odd-numbered gate lines $GL_1$, $GL_3$, . . . , $GL_{(N-1)}$ and the even-numbered pixels $P_{m2}$, $P_{m4}$, . . . , $P_{mM}$ are coupled to date line $DL_{(m+1)}$ and respectively coupled to corresponding even-numbered gate lines $GL_2$, $GL_4$, . . . , $GL_N$ (assuming N is an even number). Referring to the inset depicting the detailed structure of the pixel $P_{44}$ (as well as all other pixels), each pixel includes a TFT switch, a liquid crystal capacitor $C_{LC}$ and a storage capacitor $C_{ST}$. The TFT switch includes a first end coupled to a corresponding data line, a second end, and a control end coupled to a corresponding data line. The liquid crystal capacitor $C_{LC}$ and the storage capacitor $C_{ST}$ are both coupled between the second end of the TFT switch and a common voltage $V_{COM}$.

The gate driver 310 is coupled to the gate lines $GL_1$-$GL_N$ for sequentially generating the gate driving signals $S_{G1}$-$S_{GN}$, thereby turning on the TFT switches in corresponding pixels. The source driver 320 is coupled to the data lines $DL_1$-$DL_M$ for generating the data driving signals $S_{D1}$-$S_{DN}$ with predetermined polarities so that the pixels $P_{11}$-$P_{MN}$ can display corresponding images. In the LCD device 300 of the present invention, the nth row of pixels $P_{1n}$-$P_{mn}$ (n is a positive integer smaller than N) are arranged with an RGB sequence, as indicated by "R", "G" and "B" in FIG. 3.

The switch control circuit 340, coupled between the source driver 320 and the data lines $DL_1$-$DL_M$, can control the signal transmission paths between the source driver 320 and the data lines $DL_1$-$DL_M$ via a plurality of switches, so that the driving signals $S_{D1}$-$S_{DM}$ sent to the data lines $DL_1$-$DL_M$ have a certain polarity arrangement. In FIG. 3, the switches in the switch control circuit 340 are represented by open-circuited switch symbols, which are only for illustrative purpose. The actual status of the switches in the switch control circuit 340 will be explained in detail in the following paragraphs. In the present invention, the polarities of the data driving signals $S_{D1}$-$S_{DM}$ are inverted every S data lines. FIG. 3 illustrates an embodiment when S=2, in which the polarities of the data driving signals $S_{D1}$-$S_{DM}$ are inverted every two data lines. Therefore, when displaying frame X, the polarity arrangement of the odd-numbered rows of pixels is "++−−++−− . . . " the polarity arrangement of the even-numbered rows of pixels is "+−−++−−+ . . . "; when displaying frame (X+1) subsequent to frame X, the polarity arrangement of the odd-numbered rows of pixels is "−−++−−++ . . . " and the polarity arrangement of the even-numbered rows of pixels is "−++−−++− . . . " FIG. 3 only shows the polarity arrangement of the output signals provided by the source driver 320 when displaying frame X.

The voltage level of each data driving signal depends on the driving period of each corresponding pixel. For a pixel to display a black image, the data driving signal having a high voltage level is used during the positive polarity driving period, and the data driving signal having a low voltage level is used during the negative polarity driving period; for a pixel to display a white image, the data driving signal having a low voltage level is used during the positive polarity driving period, and the data driving signal having a high voltage level is used during the negative polarity driving period. If the voltage potential of each data line is coupled in the same direction after polarity inversion when displaying certain images (such as black/white striped patterns), the recovery time for the common voltage $V_{COM}$ may be shortened. Insufficient recovery time for the common voltage $V_{COM}$ results in striped crosstalk and image mura which largely influence the display quality.

Figures 4A, 4B:
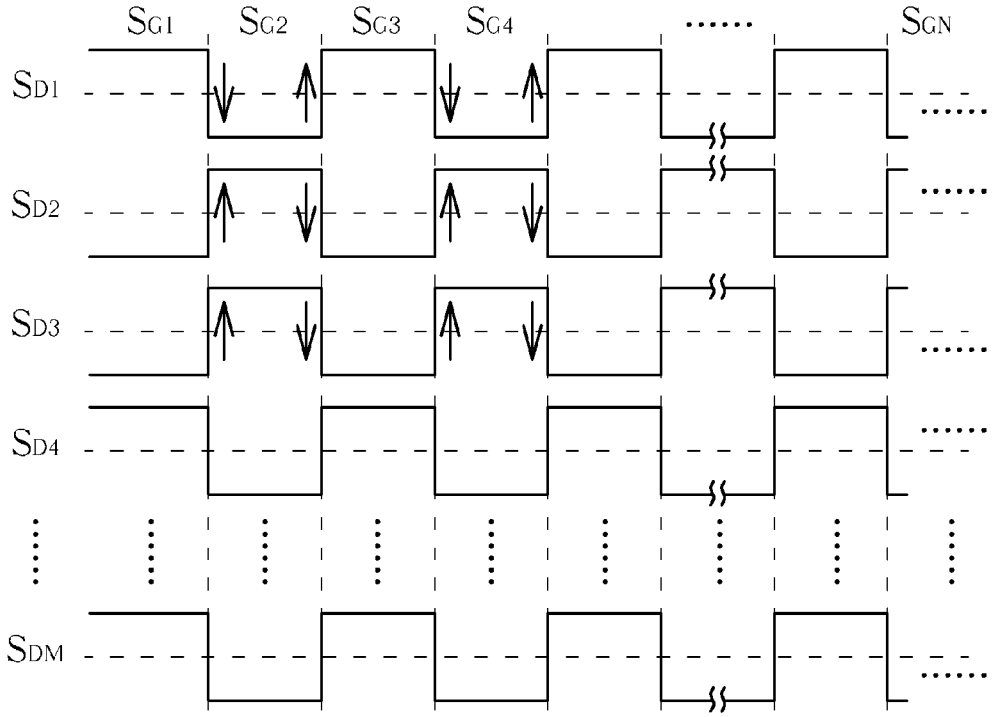
FIGS. 4*a* and 4*b* are diagrams illustrating the operations of the LCD device in FIG. 3 according to a first embodiment of the present invention.

References are made to FIGS. 4*a* and 4*b* for diagrams illustrating the operations of the LCD device 300 according to a first embodiment of the present invention. In the first embodiment, the LCD device 300 displays a first type black/white striped pattern with two-dot inversion. FIG. 4*a* shows the polarity arrangement and the voltage potential of the pixel matrix when the LCD device 300 displays frame X. FIG. 4*b* shows the waveforms of the data driving signals $S_{D1}$-$S_{DM}$ when displaying frame X. The LCD device 300 operates similarly when displaying frame (X+1).

As shown in FIG. 4*a*, it is assumed that the LCD device 300 displays the first type black/white striped pattern by displaying black images using the odd-numbered columns of pixels and by displaying white images using the even-numbered columns of pixels. The polarity of each pixel is represented by "+" or "−", while the voltage potential of the data driving signal received by each pixel is represented by "H" (high voltage level) or "L" (low voltage level). Therefore, the voltage potentials of adjacent data lines are coupled in opposite directions (indicated by the arrows in FIG. 4*b*) after polarity inversion when displaying the first type black/white striped pattern. The voltage coupling between the data lines can thus be compensated, thereby reducing striped crosstalk and improving the display quality.

Figures 5A, 5B:
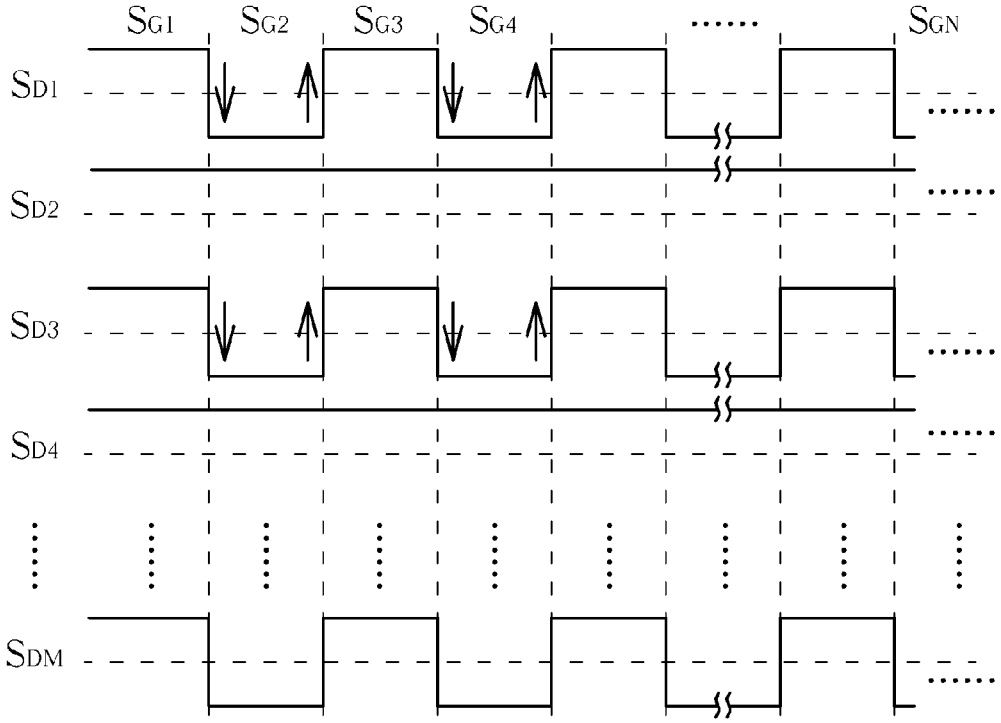
FIGS. 5*a* and 5*b* are diagrams illustrating the operations of the LCD device in FIG. 3 according to a second embodiment of the present invention.

References are made to FIGS. 5*a* and 5*b* for diagrams illustrating the operations of the LCD device 300 according to a second embodiment of the present invention. In the second embodiment, the LCD device 300 displays a second type black/white striped pattern with two-dot inversion. FIG. 5*a* shows the polarity arrangement and the voltage potential of the pixel matrix when the LCD device 300 displays frame X. FIG. 5*b* shows the waveforms of the data driving signals $S_{D1}$-$S_{DM}$ when displaying frame X. The LCD device 300 operates similarly when displaying frame (X+1).

As shown in FIG. 5*a*, it is assumed that the LCD device 300 displays the second type black/white striped pattern by displaying black images using two adjacent columns of pixels and by displaying white images using two adjacent columns of pixels. In other words, the images displayed by the first through the Mth columns of pixels are black, black, white, white, black, black, . . . , etc. The polarity of each pixel is represented by "+" or "−", while the voltage potential of the data driving signal received by each pixel is represented by "H" (high voltage level) or "L" (low voltage level). Therefore, the voltage potentials of only half data lines are coupled in the same direction (indicated by the arrows in FIG. 5*b*) after polarity inversion when displaying the second type black/white striped pattern. The voltage coupling between the data lines can partially be compensated, thereby reducing striped crosstalk and improving the display quality.

References are made to FIGS. 6*a* and 6*b* for diagrams illustrating the operations of the LCD device 300 according to a third embodiment of the present invention. In the third embodiment, the LCD device 300 displays a third type black/white striped pattern with two-dot inversion. FIGS. 6*a* and 6*b* show the polarity arrangement and the voltage potential of the pixel matrix when the LCD device 300 displays frame X and frame (X+1). It is also assumed that the LCD device 300 displays the third type black/white striped pattern by displaying black images using the odd-numbered columns of pixels and by displaying white images using the even-numbered columns of pixels. The polarity of each pixel is represented by "+" or "−". In the third embodiment of the present invention, the polarities of the pixels are also inverted every two rows of pixels. In other words, when displaying frame X, the polarity arrangement of the first and second rows of pixels is "++−−++−− . . . ", the polarity arrangement of the third and fourth rows of pixels is "+−−++−−+ . . . ", the polarity arrangement of the fifth and sixth rows of pixels is "++−−++−− . . . ", . . . , etc. Similarly, when displaying frame (X+1), the polarity arrangement of the first and second rows of pixels is "−−++−−++ . . . ", the polarity arrangement of the third and fourth rows of pixels is "−++−−++− . . . ", the polarity arrangement of the fifth and sixth rows of pixels is "−−++−−++ . . . ", . . . , etc.

Figure 7:
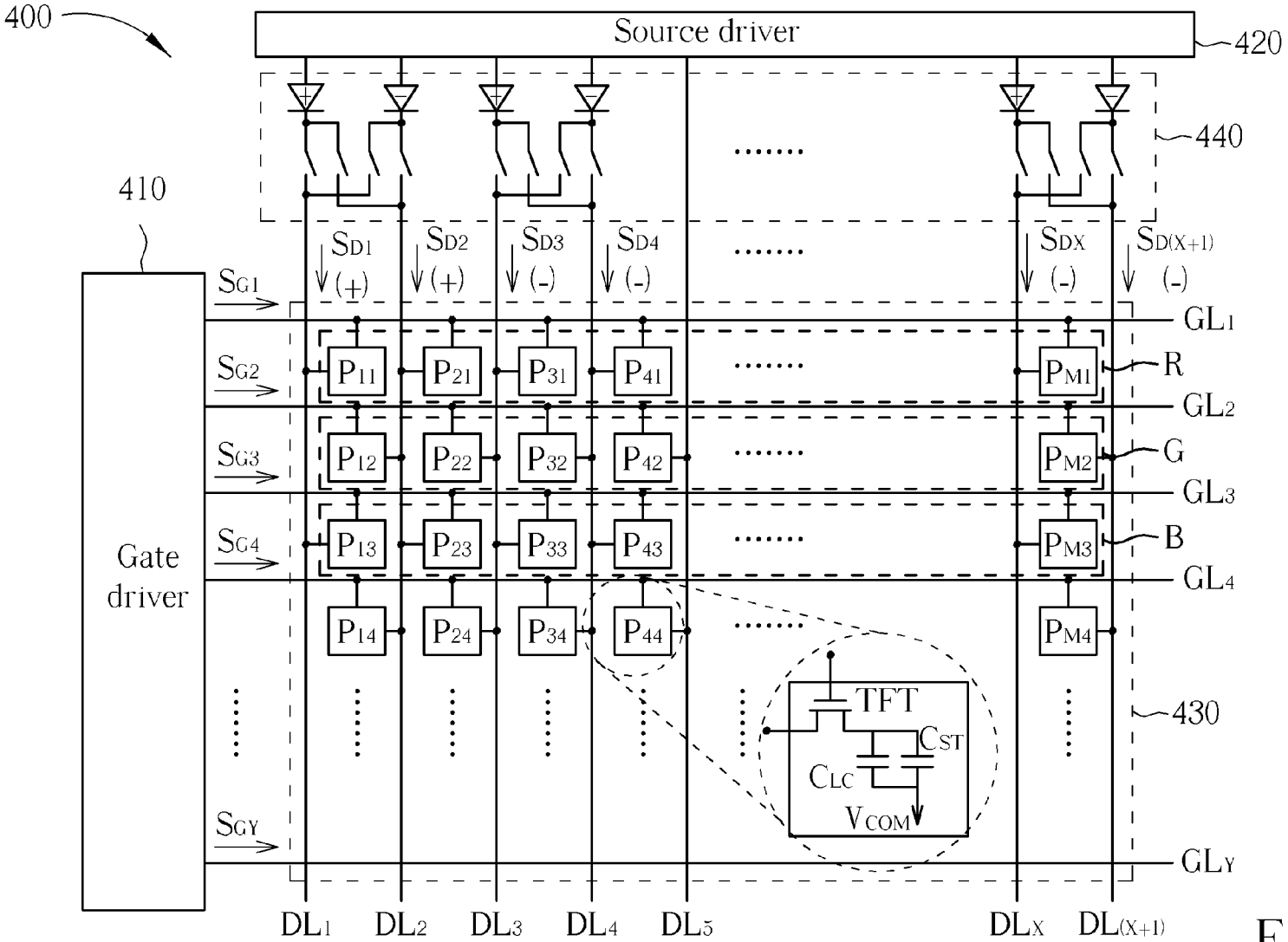
FIG. 7 is a diagram of another LCD device with zigzag pixel arrangement and single-gate structure according to the present invention.

Reference is made to FIG. 7 for a diagram of an LCD device 400 with zigzag pixel arrangement and tri-gate structure according to the present invention. The LCD device 400 includes a gate driver 410, a source driver 420, a switch control circuit 440 and an LCD panel 430. A plurality of parallel data lines $DL_1$-$DL_{X-1}$, a plurality of parallel gate lines $GL_1$-$GL_Y$ and a pixel matrix having X columns and Y rows are disposed on the LCD panel 430. The pixel matrix includes X×Y pixels $P_{11}$-$P_{XY}$ respectively disposed at the intersections of corresponding data lines and gate lines. For example, the xth column of pixels $P_{x1}$-$P_{xY}$ (x is a positive integer smaller than X) are disposed between two adjacent date lines $DL_x$ and $DL_{(x+1)}$, wherein the odd-numbered pixels $P_{x1}$, $P_{x3}$, . . . , $P_{x(Y-1)}$ are coupled to date line $DL_x$ and respectively coupled to corresponding odd-numbered gate lines $GL_1$, $GL_3$, . . . , $GL_{(Y-1)}$ and the even-numbered pixels $P_{x2}$, $P_{x4}$, . . . , $P_{xY}$ coupled to date line $DL_{(x+1)}$ and are respectively coupled to corresponding even-numbered gate lines $GL_2$, $GL_4$, . . . , $GL_Y$ (assuming Y is an even integer). Each pixel includes a TFT switch, a liquid crystal capacitor $C_{LC}$ and a storage capacitor $C_{ST}$. The gate driver 410 is coupled to the gate lines $GL_1$-$GL_Y$ for sequentially generating the gate driving signals $S_{G1}$-$S_{GY}$, thereby turning on the TFT switches in corresponding pixels. The source driver 420 is coupled to the data lines $DL_1$-$DL_X$ for generating the data driving signals $S_{D1}$-$S_{DX}$ so that the pixels $P_{11}$-$P_{XY}$ can display corresponding images. In the LCD device 400 of the present invention, the xth column of pixels $P_{x1}$-$P_{xY}$ (x is a positive integer smaller than X) are arranged with an RGB sequence, as indicated by "R", "G" and "B" in FIG. 7. In other words, the pixels coupled to the gate line $GL_1$ are R pixels, the pixels coupled to the gate line $GL_2$ are G pixels, the pixels coupled to the gate line $GL_3$ are B pixels, . . . , etc.

With the same resolution, the number of data lines in the tri-gate LCD device 400 is three times more than those of the single-gate LCD device 300 (Y=3N), and the number of gate lines in the tri-gate LCD device 400 is one third fewer than those of the single-gate LCD device 300 (M=3 X). The tri-gate LCD device 400 thus requires more gate driving chips and fewer source driving chips. Since the gate driving chip is less expensive and consumes less power, the tri-gate LCD device 400 can reduce manufacturing cost and power consumption.

However, since the tri-gate LCD device 400 requires more gate lines, the recovery time of the common voltage $V_{COM}$ is also shorter, which is more likely to cause image mura when displaying certain images (such as black/white striped patterns). Therefore, the switch control circuit 440 of the LCD device 400 can output the data driving signals $S_{D1}$-$S_{DX}$ having corresponding polarities to the data lines $DL_1$-$DL_X$, so that the polarities of the data driving signals $S_{D1}$-$S_{DX}$ are inverted every S data lines. FIG. 7 illustrates an embodiment when S=2, in which the polarities of the data driving signals $S_{D1}$-$S_{DX}$ are inverted every two data lines. The operations of the LCD device 400 when displaying different types of black/white striped patterns can also be illustrated by FIGS. 4*b*-6*b*.

Figure 8A:
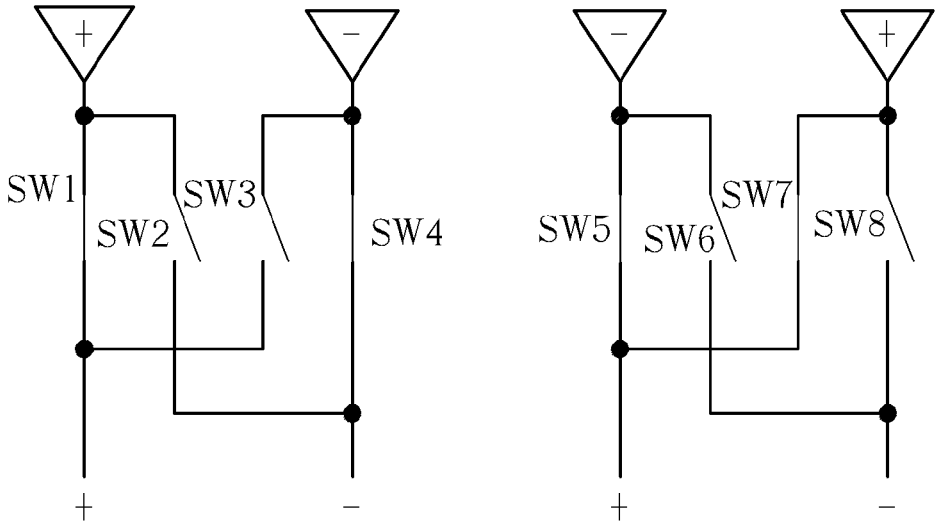
FIGS. 8*a*-8*d* are diagrams illustrating the status of the switches in the switch control circuit for achieving various display methods.
Figure 8B:
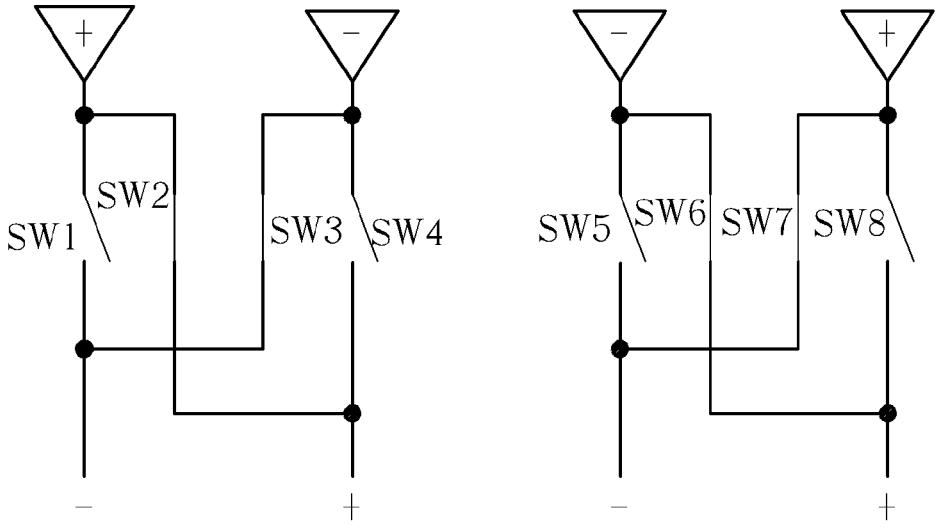
Figure 8C:
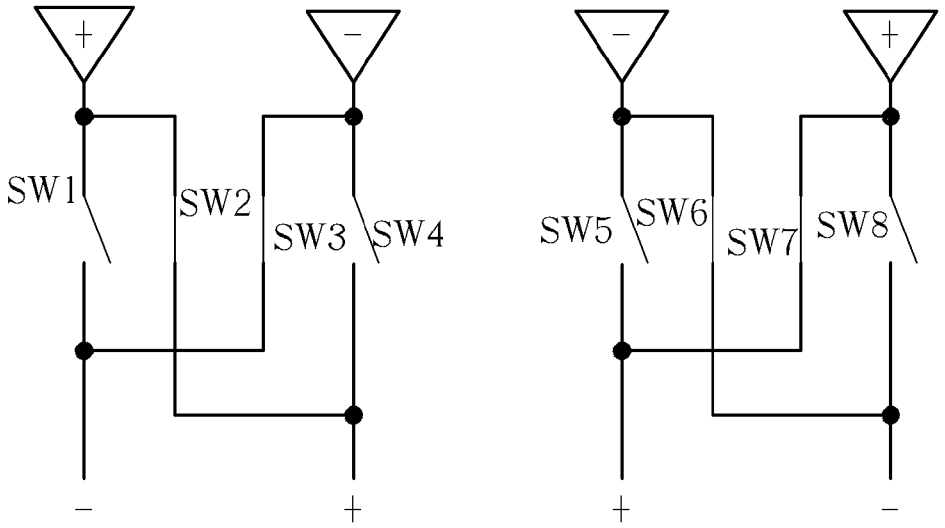
Figure 8D:
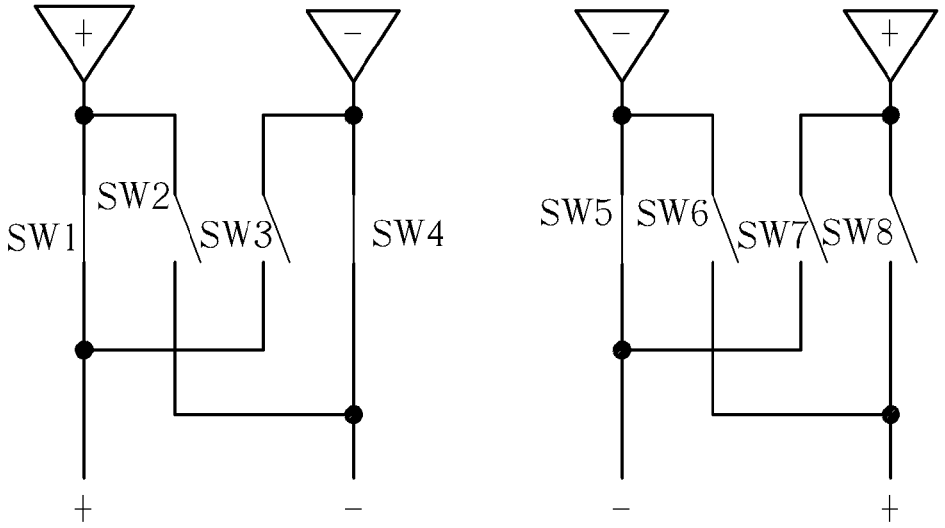

References are made to FIGS. 8*a*-8*d* for diagrams illustrating the status of the switches in the switch control circuit 340 for achieving various display methods. Each of FIGS. 8*a*-8*d* depicts a partial structure of the switch control circuit 340 which controls the signal transmission path between the source driver and 4 adjacent data lines (such as the data lines $DL_1$-$DL_4$). The switches shown in FIGS. 8*a*-8*d* are labeled SW1-SW8 for ease of explanation. For 1-dot/1-column inversion, positive polarity data can be provided by turning on the switches SW1, SW4, SW5, SW7 and turning off the switches SW2, SW3, SW6, SW8 (as illustrated in FIG. 8*a*), while negative polarity data can be provided by turning on the switches SW2, SW3, SW6, SW7 and turning off the switches SW1, SW4, SW5 and SW8 (as illustrated in FIG. 8*b*). For 2-dot/2-column inversion, positive polarity data can be provided by turning on the switches SW2, SW3, SW6, SW7 and turning off the switches SW1, SW4, SW5, SW8 (as illustrated in FIG. 8*c*), while low polarity data can be provided by turning on the switches SW1, SW4, SW5, SW8 and turning off the switches SW2, SW3, SW6, SW7 (as illustrated in FIG. 8*d*).

Therefore, when the LCD devices 300 and 400 according to the present invention display black/white striped patterns, the voltage potentials of adjacent data lines are coupled in opposite directions, or the voltage potentials of only half data lines are coupled in the same direction. The voltage coupling between the data lines can thus be compensated, thereby reducing striped crosstalk and improving the display quality.

Those skilled in the art will readily observe that numerous modifications and alterations of the device and method may be made while retaining the teachings of the invention.

What is claimed is:

1. An LCD device with multi-dot inversion comprising:

a plurality of data lines each for transmitting data driving signals;

a plurality of gate lines for transmitting gate driving signals;

a pixel matrix comprising:

an mth pixel column including a plurality of pixels and disposed between two adjacent mth and (m+1)th data lines among the plurality of data lines, wherein:

odd-numbered pixels of the mth pixel column are coupled to the mth data line, and respectively coupled to corresponding odd-numbered gate lines; and even-numbered pixels of the mth pixel column are coupled to the (m+1)th data line, and respectively coupled to corresponding even-numbered gate lines;

an (m+1)th pixel column including a plurality of pixels and disposed between two adjacent (m+1)th and (m+2)th data lines among the plurality of data lines, wherein:

odd-numbered pixels of the (m+1)th pixel column are coupled to the (m+1)th data line and respectively coupled to corresponding odd-numbered gate lines; and even-numbered pixels of the (m+1)th pixel column are coupled to the (m+2)th data line and respectively coupled to corresponding even-numbered gate lines;

wherein pixels coupled to an nth gate line are of a first color, pixels coupled to an (n+1)th gate line are of a second color, pixels coupled to an (n+2)th gate line are of a third color, the first, second and third colors are different, and m, n are positive integers; and a source driver for outputting data driving signals having a first polarity to odd-numbered data lines and for outputting data driving signals having a second polarity to even-numbered data lines when displaying a first frame.

2. The LCD device of claim 1 further comprising:

a switch circuit coupled between the source driver and the plurality of data lines for controlling signal transmission paths between the data driving signals and the plurality of data lines and for changing the polarity of the data driving signals.

3. The LCD device of claim 1 wherein the switch circuit transmits the data driving signals having the second polarity to the odd-numbered data lines and transmits the data driving signals having the first polarity to the even-numbered data lines when displaying a second frame subsequent to the first frame.

4. The LCD device of claim 1 wherein each pixel among the plurality of pixels comprises:

a switch including:

a first end coupled to a data line corresponding to the pixel;

a second end; and a control end coupled to a gate line corresponding to the pixel;

a liquid crystal capacitor coupled between the second end of the switch and a common node; and a storage capacitor coupled between the second end of the switch and the common node.

5. The LCD device of claim 4 wherein the switch includes a thin film transistor (TFT) and the control end of the switch is a gate of the TFT.

6. The LCD device of claim 1 further comprising:

a gate driver coupled to the plurality of gate lines for generating the gate driving signals.

7. An LCD device with two-dot inversion comprising:

a first data line, a second data line, a third data line, a fourth data line and a fifth data lines for transmitting data driving signals;

a first gate line, a second gate line and a third gate line for transmitting gate driving signals;

a pixel matrix comprising:

a first pixel disposed at a first row and a first column of the pixel matrix and coupled to the first data line and the first gate line for displaying images according to the received gate driving signal and data driving signal;

a second pixel disposed at the first row and a second column of the pixel matrix and coupled to the second data line and the first gate line for displaying images according to the received gate driving signal and data driving signal;

a third pixel disposed at the first row and a third column of the pixel matrix and coupled to the third data line and the first gate line for displaying images according to the received gate driving signal and data driving signal;

a fourth pixel disposed at the first row and a fourth column of the pixel matrix and coupled to the fourth data line and the first gate line for displaying images according to the received gate driving signal and data driving signal;

a fifth pixel disposed at a second row and the first column of the pixel matrix and coupled to the second data line and the second gate line for displaying images according to the received gate driving signal and data driving signal;

a sixth pixel disposed at the second row and the second column of the pixel matrix and coupled to the third data line and the second gate line for displaying images according to the received gate driving signal and data driving signal;

a seventh pixel disposed at the second row and the third column of the pixel matrix and coupled to the fourth data line and the second gate line for displaying images according to the received gate driving signal and data driving signal;

an eighth pixel disposed at the second row and the fourth column of the pixel matrix and coupled to the fifth data line and the second gate line for displaying images according to the received gate driving signal and data driving signal;

a ninth pixel disposed at a third row and the first column of the pixel matrix and coupled to the first data line and the third gate line for displaying images according to the received gate driving signal and data driving signal;

a tenth pixel disposed at the third row and the second column of the pixel matrix and coupled to the second data line and the third gate line for displaying images according to the received gate driving signal and data driving signal;

an eleventh pixel disposed at the third row and the third column of the pixel matrix and coupled to the third data line and the third gate line for displaying images according to the received gate driving signal and data driving signal; and a twelfth pixel disposed at the third row and the fourth column of the pixel matrix and coupled to the fourth data line and the third gate line for displaying images according to the received gate driving signal and data driving signal;

wherein:

the first through fourth pixels are of a first color;

the fifth through eight pixels are of a second color;

the ninth through twelfth pixels are of a third color; and the first, second and third colors are different; and a source driver for outputting data driving signals having a first polarity to the first, the second and the fifth data lines and for outputting data driving signals having a second polarity to the third and the fourth data lines when displaying a first frame.

8. The LCD device of claim 7 wherein the source driver further outputs the data driving signals having the second polarity to the first, the second and the fifth data lines and outputs the data driving signals having the first polarity to the third and the fourth data lines when displaying a second frame subsequent to the first frame.

9. The LCD device of claim 7 wherein each pixel comprises:

a switch including:

a first end coupled to a data line corresponding to the pixel;

a second end; and a control end coupled to a gate line corresponding to the pixel;

a liquid crystal capacitor coupled between the second end of the switch and a common node; and a storage capacitor coupled between the second end of the switch and the common node.

10. The LCD device of claim 9 wherein the switch includes a TFT and the control end of the switch is a gate of the TFT.

11. The LCD device of claim 7 further comprising:

a gate driver coupled to the plurality of gate line sets for generating the gate driving signals.

12. A method for driving an LCD device with multi-dot inversion comprising:

providing a plurality of data lines;

providing a plurality of gate lines;

providing a pixel matrix comprising a plurality of pixel columns having a zigzag layout, wherein an mth pixel column including a plurality of pixels are disposed between two adjacent mth and (m+1)th data lines among the plurality of data lines, odd-numbered pixels of the mth pixel column are coupled to the mth data line and respectively coupled to corresponding odd-numbered gate lines, even-numbered pixels of the mth pixel column are coupled to the (m+1)th data line and respectively coupled to corresponding even-numbered gate lines, pixels coupled to an nth gate line are of a first color, pixels coupled to an (n+1)th gate line are of a second color, pixels coupled to an (n+2)th gate line are of a third color, the first, second and third colors are different, and m, n are positive integers; and outputting data driving signals having a first polarity to odd-numbered data lines and outputting data driving signals having a second polarity to even-numbered data lines when displaying a first frame.

13. The method of claim 12 further comprising:

outputting the data driving signals having the first polarity to even-numbered data lines and outputting the data driving signals having the second polarity to odd-numbered lines when displaying a second frame subsequent to the first frame.

14. An LCD device with multi-dot inversion comprising:

M data lines each for transmitting data driving signals;

N gate lines for transmitting gate driving signals;

a source driver for outputting data driving signals to the M data lines when displaying a frame, wherein polarities of the data driving signals received by the M data lines are inverted every S data lines so that:

an mth data line to an (m+S−1) data line among the M data lines are arranged to receive the data driving signals having a first polarity; and an (m+S) th data line to an (m+2s−1) data line among the M data lines are arranged to receive the data driving signals having a second polarity opposite to the first polarity; and a pixel matrix comprising M pixel columns and N pixel rows, wherein:

an mth pixel column among the M pixel columns includes a plurality of pixels disposed between two adjacent mth and (m+1)th data lines among the M data lines and having the first polarity;

an (m+1)th pixel column among the M pixel columns includes a plurality of pixels disposed between two adjacent (m+1)th and (m+2)th data lines among the M data lines;

odd-numbered pixels of the mth pixel column are coupled to the mth data line, and respectively coupled to corresponding odd-numbered gate lines;

even-numbered pixels of the mth pixel column are coupled to the (m+1)th data line, and respectively coupled to corresponding even-numbered gate lines;

odd-numbered pixels of the (m+1)th pixel column are coupled to the (m+1)th data line and respectively coupled to corresponding odd-numbered gate lines;

even-numbered pixels of the (m+1)th pixel column are coupled to the (m+2)th data line and respectively coupled to corresponding even-numbered gate lines;

M, N, S and m are positive integer, M>m and M>S>1.

15. The LCD device of claim 14, wherein:

an (m+S)th pixel column among the M pixel columns includes a plurality of pixels disposed between two adjacent (m+S)th and (m+S+1)th data lines among the M data lines and having the second polarity.

16. The LCD device of claim 14, wherein a first pixel in the (m+1)th pixel column and a second pixel in an (m+S+1)th pixel column coupled to a same gate line have opposite polarities.

17. The LCD device of claim 14, wherein:

two adjacent pixels of the mth pixel column which are respectively coupled to an nth gate line and an (n+1) gate line have the first polarity;

two adjacent pixels of the mth pixel column which are respectively coupled to an (n+2) th gate line and an (n+3) gate line have the second polarity;

n is a positive integer, and N>(n+3).

* * * * *